US007705238B2

(12) United States Patent
Van Swearingen

(10) Patent No.: US 7,705,238 B2
(45) Date of Patent: Apr. 27, 2010

(54) COAXIAL RF DEVICE THERMALLY CONDUCTIVE POLYMER INSULATOR AND METHOD OF MANUFACTURE

(75) Inventor: Kendrick Van Swearingen, Woodridge, IL (US)

(73) Assignee: Andrew LLC, Hickory, NC (US)

( * ) Notice: Subject to any disclaimer, the term of this patent is extended or adjusted under 35 U.S.C. 154(b) by 688 days.

(21) Appl. No.: 11/690,091

(22) Filed: Mar. 22, 2007

(65) Prior Publication Data

US 2007/0267717 A1 Nov. 22, 2007

Related U.S. Application Data

(60) Provisional application No. 60/747,934, filed on May 22, 2006.

(51) Int. Cl.
*H01B 7/00* (2006.01)

(52) U.S. Cl. ..... 174/28; 174/102 R; 174/110 R; 174/113 AS

(58) Field of Classification Search ..... 174/28, 174/36, 102 R, 102 SP, 110 R, 113 R, 113 AS, 174/121 R, 124 G, 137 R, 146, 149 R, 154, 174/158 R, 167, 168; 333/84 L, 237
See application file for complete search history.

(56) References Cited

U.S. PATENT DOCUMENTS 2,599,857 A * 6/1952 Mildner ..... 264/145
3,286,015 A * 11/1966 Hildebrand et al. ..... 174/29
3,310,520 A 3/1967 Girard
4,011,118 A * 3/1977 Geominy ..... 156/51
4,240,124 A 12/1980 Westrom
5,309,320 A 5/1994 Smith
5,812,374 A 9/1998 Shuff
5,828,007 A 10/1998 Fujishita et al.
5,922,155 A * 7/1999 Clouet et al. ..... 156/51
6,130,385 A 10/2000 Tuunanen et al.
6,201,700 B1 3/2001 Tzinares et al.
6,346,671 B1 * 2/2002 Ahrens et al. ..... 174/28
6,367,541 B2 4/2002 McCullough
6,377,219 B2 4/2002 Smith
6,420,963 B1 7/2002 Rossetti et al.
6,487,073 B2 11/2002 McCullough et al.
6,543,524 B2 4/2003 McCullough et al.
6,733,324 B1 5/2004 Lecsek et al.

(Continued)

FOREIGN PATENT DOCUMENTS

DE 1906286 12/1970

(Continued)

OTHER PUBLICATIONS

European Search Report, Counterpart EPO patent application serial No. EP07106811, issued Jun. 20, 2008.

*Primary Examiner*—William H Mayo, III
(74) *Attorney, Agent, or Firm*—Babcock IP, PLLC

(57) ABSTRACT

An insulator supporting an inner conductor within the outer conductor of a coaxial device formed from a portion of thermally conductive polymer composition with a thermal conductivity of at least 4 W/m-K. The portion is dimensioned with an outer diameter in contact with the outer conductor and a coaxial central bore supporting there through the inner conductor. Cavities may be formed in the portion for dielectric matching and or material conservation purposes. The insulator may be cost effectively fabricated via injection molding.

20 Claims, 6 Drawing Sheets

U.S. PATENT DOCUMENTS

| | | | | |
|---|---|---|---|---|
| 6,815,617 | B1 * | 11/2004 | Gebs et al. | 174/113 AS |
| 6,817,096 | B2 | 11/2004 | McCullough | |
| 6,870,246 | B1 | 3/2005 | Mullen et al. | |
| 6,919,504 | B2 | 7/2005 | McCutcheon et al. | |
| 6,976,769 | B2 | 12/2005 | McCullough et al. | |
| 6,981,805 | B2 | 1/2006 | Miller et al. | |
| 7,124,806 | B1 | 10/2006 | Wang et al. | |
| 7,147,041 | B2 | 12/2006 | Mitchel et al. | |
| 7,462,451 | B2 * | 12/2008 | Skrzypczynski et al. | 435/6 |
| 2005/0230145 | A1 * | 10/2005 | Ishii et al. | 174/113 AS |

FOREIGN PATENT DOCUMENTS

| | | |
|---|---|---|
| DE | 2121688 | 11/1972 |
| WO | 9957190 | 11/1999 |
| WO | 0154141 | 7/2001 |

* cited by examiner

COAXIAL RF DEVICE THERMALLY CONDUCTIVE POLYMER INSULATOR AND METHOD OF MANUFACTURE

CROSS REFERENCE TO RELATED APPLICATIONS

This application claims the benefit of U.S. Provisional Patent Application No.: 60/747,934 filed May 22, 2006 and hereby incorporated by reference in the entirety.

BACKGROUND

1. Field of the Invention

The invention generally relates to improvements in the power handling capabilities of inline RF devices for use with coaxial cables. More particularly, the invention relates to methods and apparatus for improving heat dissipation in these devices via thermally conductive insulator(s).

2. Description of Related Art

There is an escalation in the amount of power, such as system overlays, that Coaxial RF devices such as RF connectors and surge devices are being required to handle which in turn increases the heat generated in such devices. In particular, a DC Block or Bias-Tee element applied to the inner conductor of an in-line coaxial device will generate significant heat levels that, if not dissipated, may damage or destroy the device.

Thermally conductive polymers incorporate a, for example, ceramic filler material to create a polymer with a greatly increased thermal conductivity characteristic. Heat sinks, enclosures and overmoldings applying thermally conductive polymers have been cost effectively formed via injection molding to improve heat dissipation characteristics for electrical components and or electrical circuit modules.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
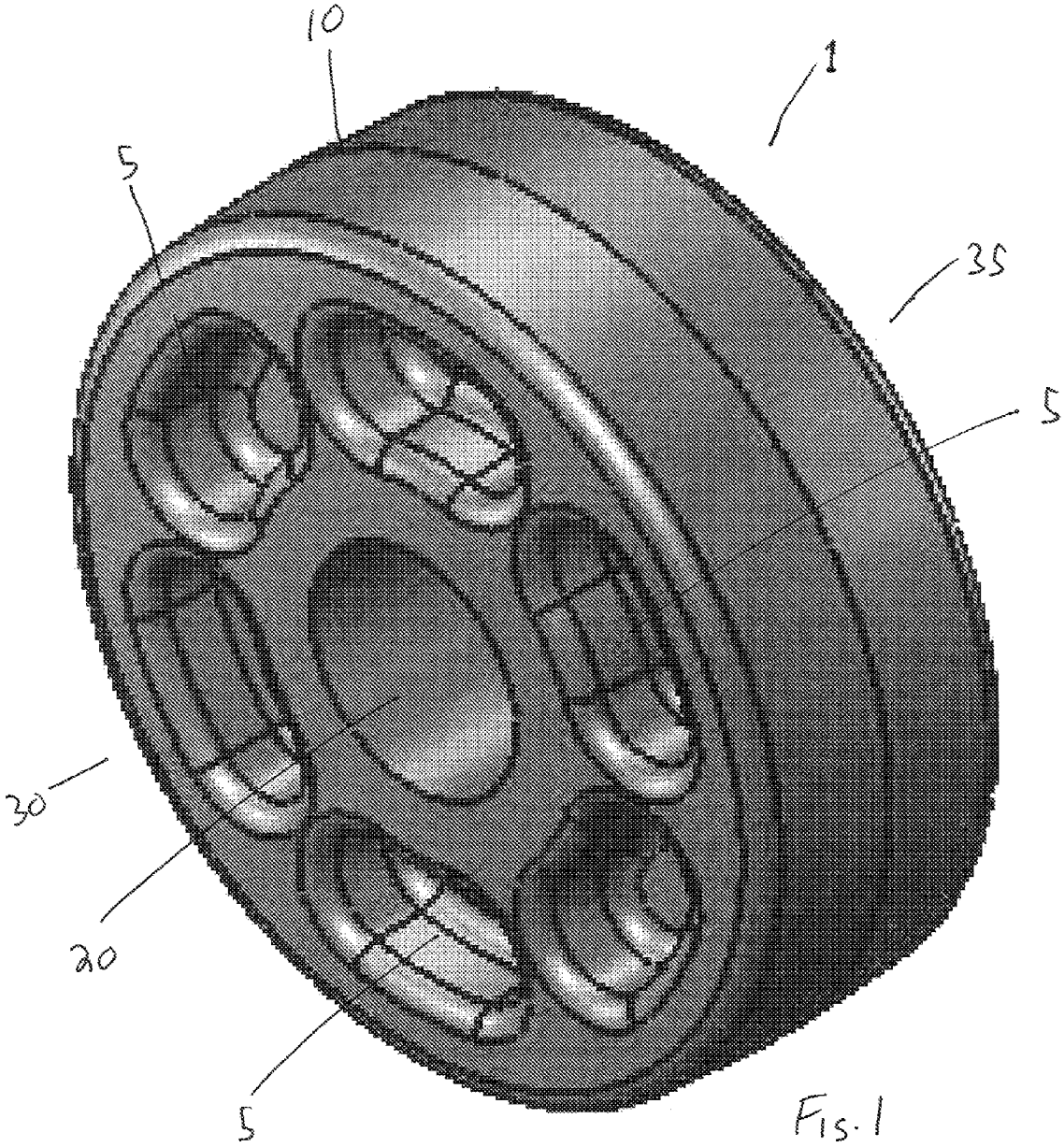
FIG. 1 is an isometric view of an exemplary thermally conductive insulator according to the invention.
Figure 3:
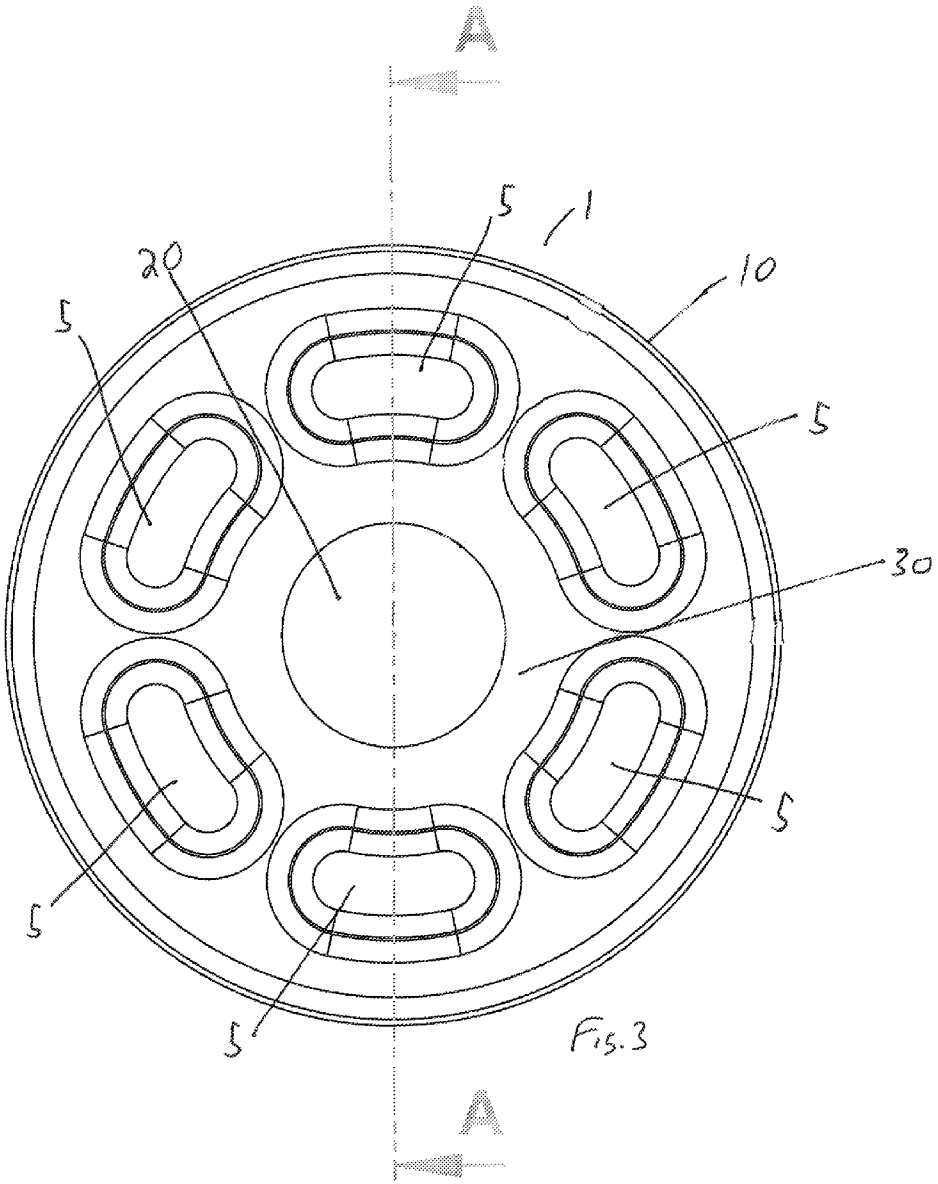
FIG. 3 is an side schematic view of FIG. 1.
Figure 2:
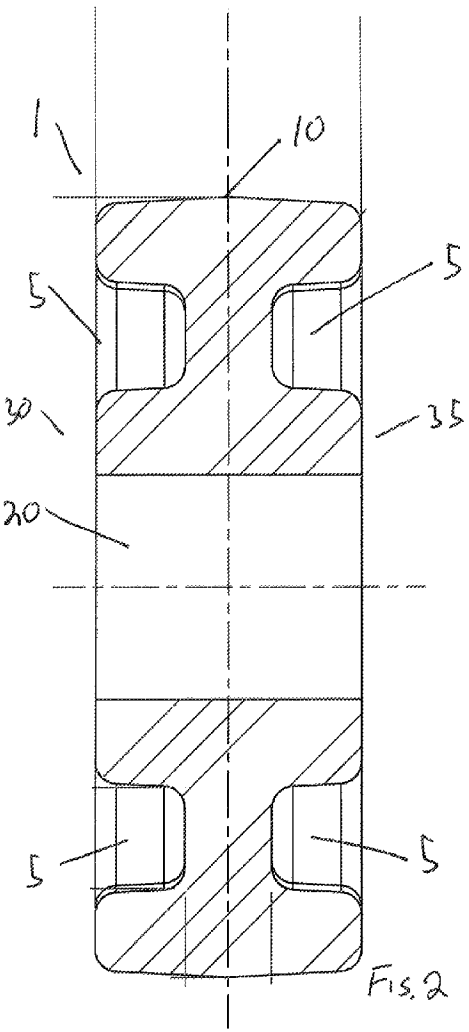
FIG. 2 is a section view of FIG. 3, along line A-A.
Figure 4:
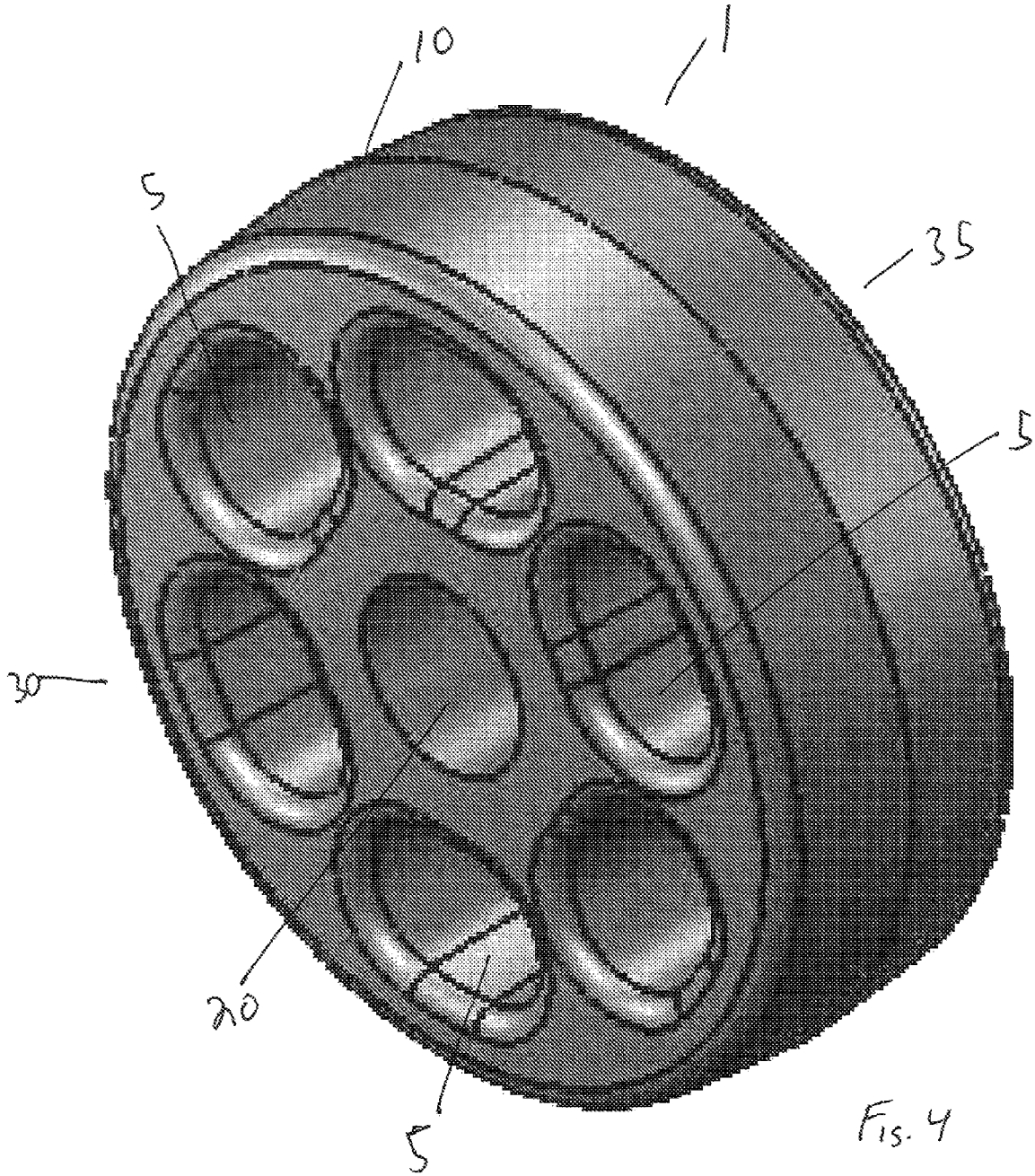
FIG. 4 is an isometric view of an alternative embodiment of a thermally conductive insulator according to the invention.
Figure 6:
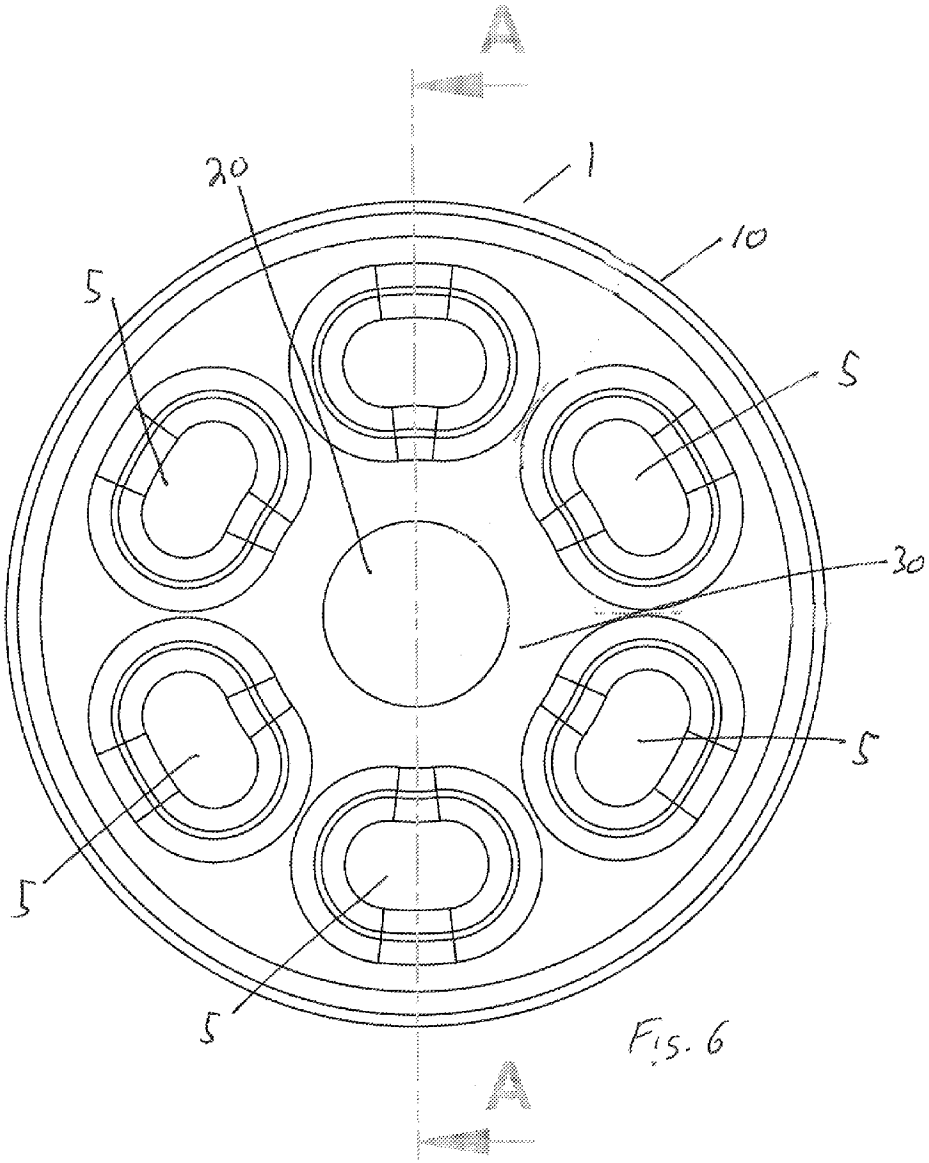
FIG. 6 is a side view of FIG. 4.
Figure 5:
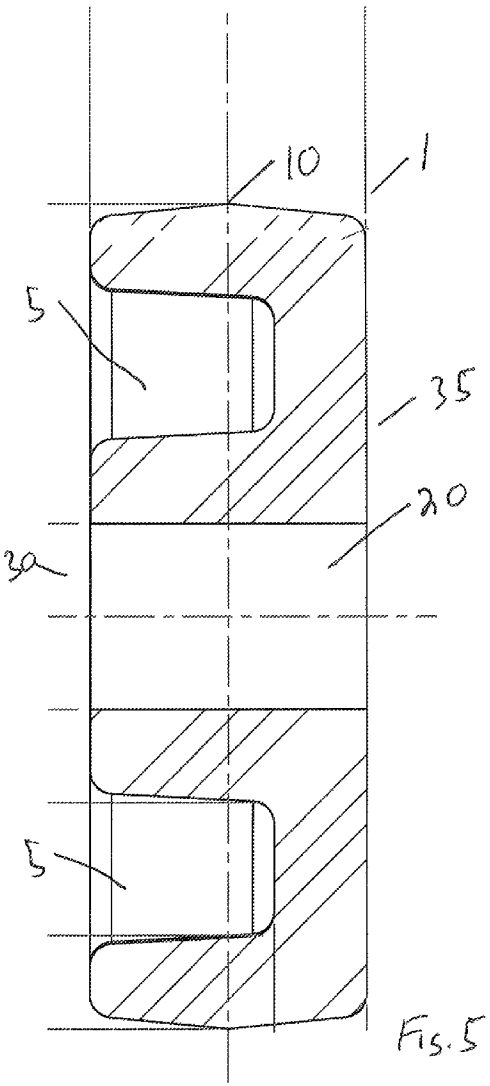
FIG. 5 is a section view of FIG. 6, along line A-A.
Figure 8:
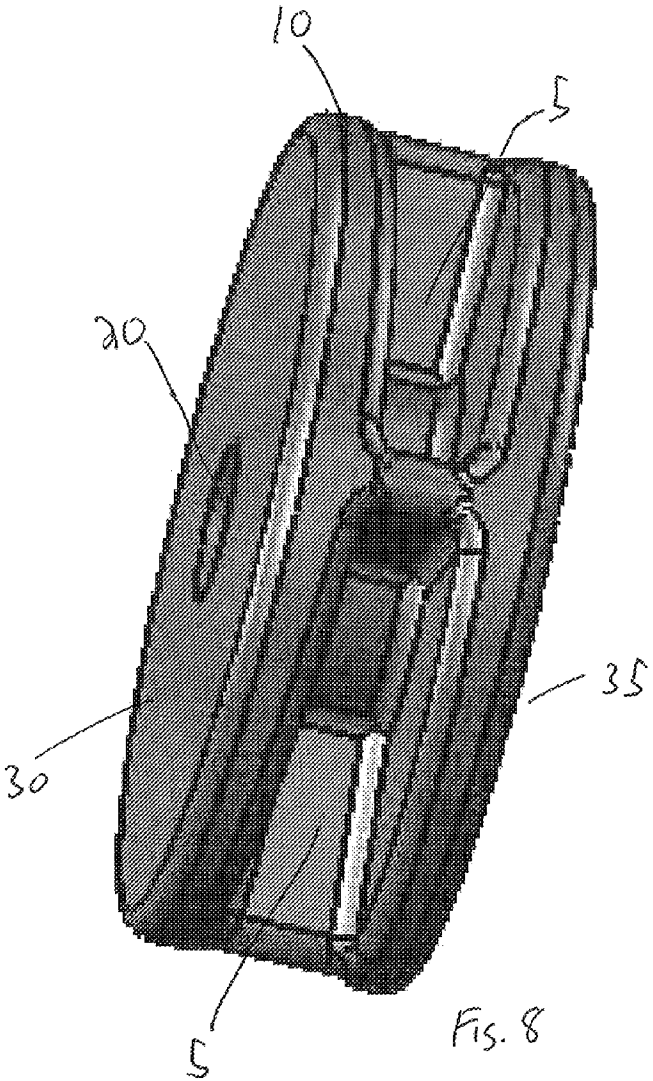
FIG. 8 is an isometric end view of FIG. 7.
Figure 7:
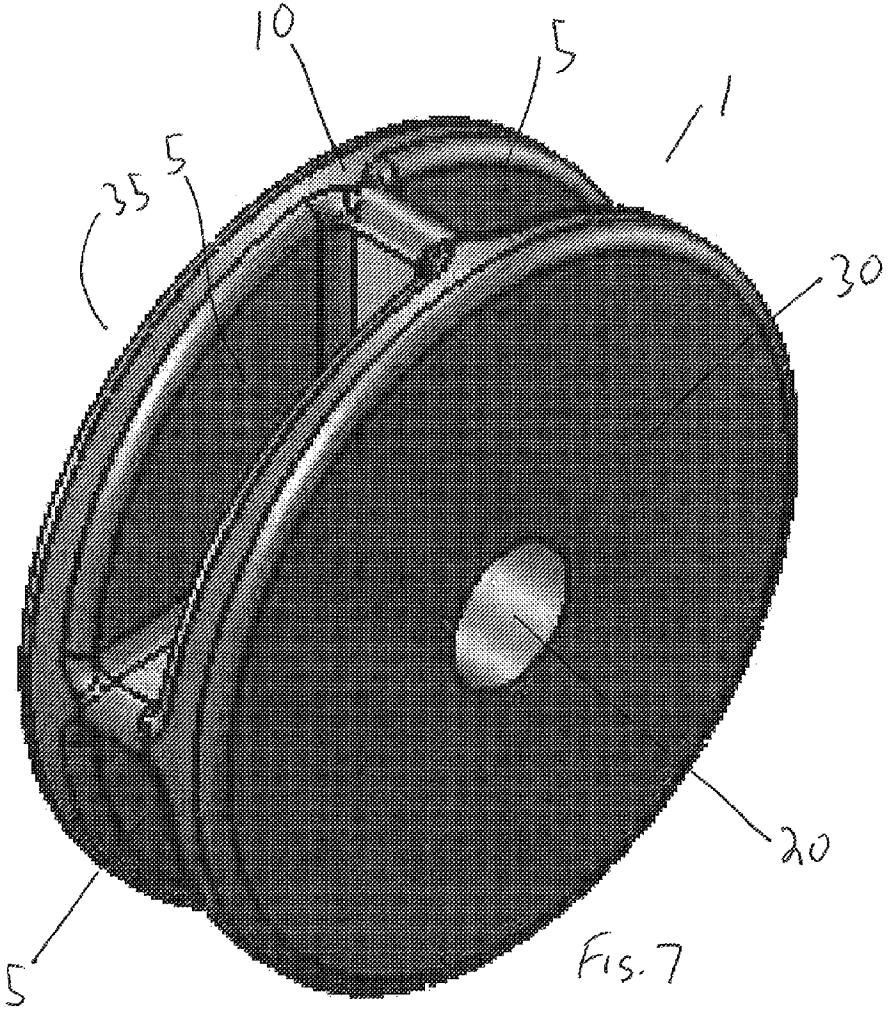
FIG. 7 is an isometric view of another alternative embodiment of a thermally conductive insulator according to the invention.

In-line coaxial devices utilize insulators to position elements of the inner conductor coaxially within the outer conductor, without electrically coupling the inner and outer conductors. In the prior art, the insulator material was selected primarily based upon the dielectric value, ease of fabrication and cost. Typically, the insulators are polytetrafluoroethylene (PTFE) or polyetherimide (PEI) both of which have advantageous dielectric properties but that are both relatively non-thermally conductive.

The inventor has recognized that these insulators and any enclosed air space between the inner conductor and the surrounding outer conductor create an insulated thermal pocket around a section of inner conductor and any devices coupled to the inner conductor there between. In devices according to the invention, the thermal insulating effect of the prior relatively non-thermally conductive insulators may be significantly reduced by application of a thermally conductive polymer composition. The high thermal conductivity capacity of these polymer compositions operates to create a conductive heat transfer path through the insulator to conduct heat away from the inner conductor to the outer conductor that then operates as an effective heat sink to the surrounding ambient atmosphere. By improving heat dissipation of the device, startling power handling capability improvements have been realized.

PTFE has a thermal conductivity of 1.7 W/mK; the thermal conductivity for PEI is approximately 0.9 W/mK. For descriptive purposes, a thermally conductive polymer composition has a thermal conductivity characteristic of at least 4 W/mK. A thermally conductive polymer composition may be formed from a base polymer and thermally conductive filler material. The base polymer may be polyphenylene sulfide (PPS), thermoplastic elastomer (TPE), polypropylene (PP), liquid crystal polymer (LCP) or the like, and boron nitride particles, carbon fibers or ceramic particles may be used as the thermally conductive filler materials. In one exemplary thermally conductive polymer composition, the thermally conductive polymer composition includes 30 to 60% of a base polymer, 25% to 50% of a first thermally conductive filler material, and 10 to 25% of a second thermally conductive filler material. An example of a commercially available thermally conductive polymer composition with suitable dielectric properties is CoolPoly® D5108 from Cool Polymers, Inc. of Warwick, R.I., which has a significantly improved thermal conductivity property of 10 W/mK.

One consideration of a thermally conductive polymer composition application as a coaxial insulator is equalization of the dielectric constant of the resulting insulator with that of the coaxial line it is designed for use with. For example CoolPoly® D5108 has a dielectric constant, measured at one megahertz, of 3.7 while standard PTFE typically has a dielectric constant around 2.

To compensate for an increased dielectric constant characteristic of the thermally conductive polymer composition, the cross sectional area of the insulator 1 may be adjusted. For example, as shown in FIGS. 1-8 an insulator 1 may be formed with a plurality of pockets or other cavities 5 applied to adjust the cross sectional area of a portion of thermally conductive polymer composition dimensioned to contact an outer conductor 15 of the coaxial line around an outer periphery 10 and having a central bore 20 dimensioned to contact the inner conductor 25. As shown for example in FIGS. 7 and 8, the cavities 5 may be formed in a circle sector shape, preferably having four cavities 5, creating a uniformly distributed spoke configuration in the remaining material adaptable for two axis mold separation during fabrication, for example, via injection molding. Alternatively, the insulator 10 may be formed in a cylindrical form with, for example, cavities at a front end 30 and or at a back end 35. To improve mold release characteristics during manufacture via injection molding, each of the pockets and or cavities may be formed open to only one face of the insulator 10.

The inventor tested an Andrew Corporation ABT-DFDM-DB Coaxial Bias-Tee Device with conventional solid cylindrical PTFE non-thermally conductive insulators at each end. The device experienced thermal failure after several minutes of operation at 500 W @ 883 MHz plus a 250 W @ 1940 MHz overlay. When the insulators, only, were exchanged with thermally conductive polymer composition insulators, specifically the CoolPoly® D5108 thermally conductive material, the device operated in a steady state at 244° F. under a further 160 W reflected load for a total of 910 W.

Figure 9:
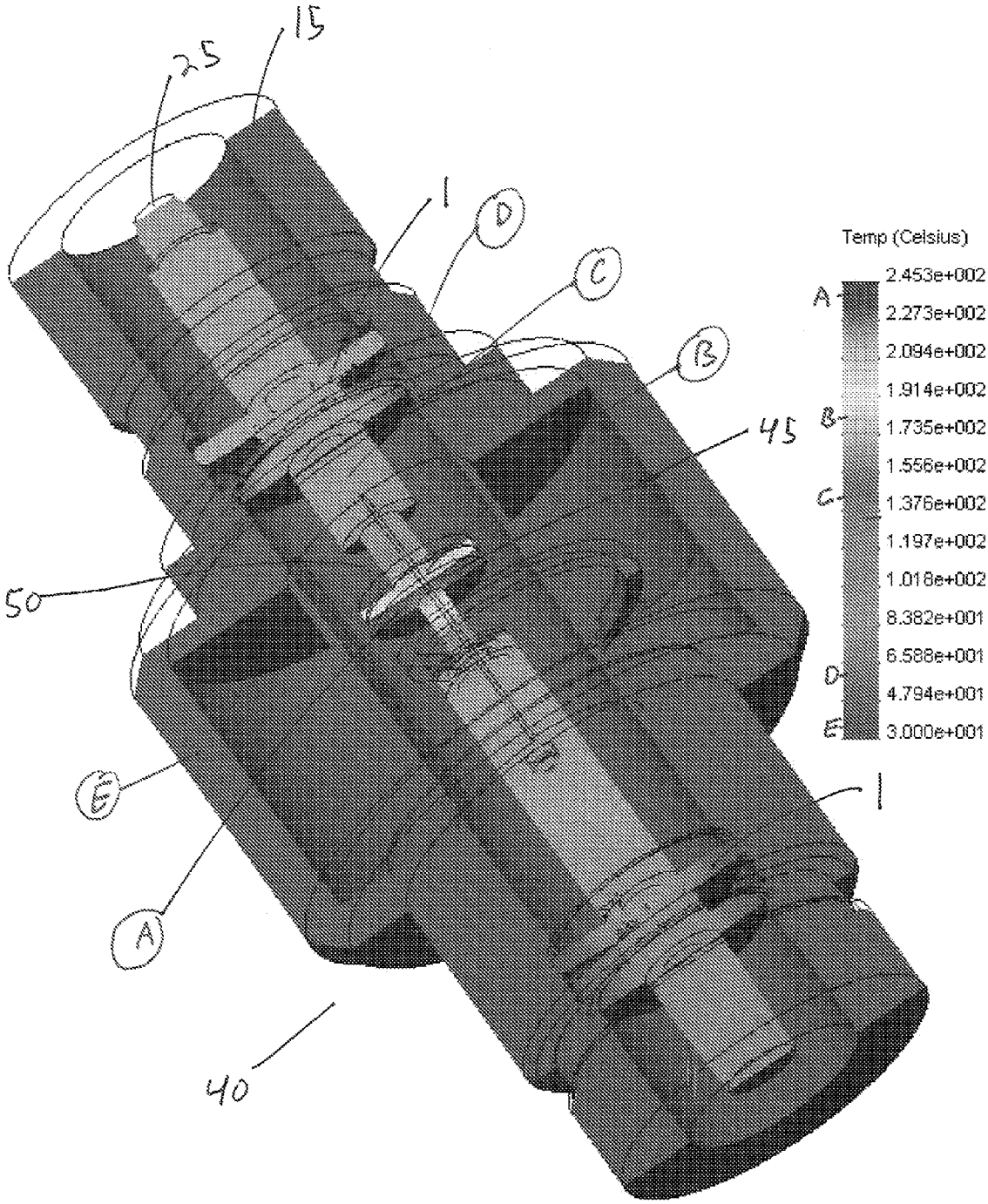
FIG. 9 is a thermal model of a coaxial RF device shown in an isometric cross section, colored in a gradient between red and blue representing the temperature from hot to cold.

Further, FEA thermal modeling analysis was performed based upon 5 watts steady thermal load applied to a capacitive break 45 on the center conductor of a coaxial RF device 40, the center conductor supported by insulators 10 of a thermally conductive polymer composition according to the invention. FIG. 9 shows the FEA thermal model analysis results, with a color gradient from red to blue, red representing the hottest area. Letter notations are applied to representative areas of the model and to the corresponding temperature scale for ease of review. Un-dissipated heat at the central area 50 would have built up and, for example, melted the insulating element of the capacitive break 45 or otherwise thermally destroyed the device according to the physical tests on common PTFE insulator coaxial devices, described herein above. In contrast, FIG. 9 demonstrates a steady state thermal profile, in which the central area 50 and or capacitive break 45 never exceeds the heat limits of the coaxial RF device 40 materials.

One skilled in the art will appreciate that an insulator 10 according to the present invention may be applied to any coaxial RF device 40 where improved heat dissipation, and thereby greater power capacity is desired. For example, the present invention may be applied as the supporting insulator 1 in coaxial portions of antennas and in-line coaxial devices such as surge arrestors, filters, bias-tees, signal taps, DC breaks, connectors or the like. Because heat dissipation and thereby power handling is so dramatically improved, the overall size of the devices may be reduced, further reducing materials costs, overall device weight and installation space requirements.

Table of Parts

| | |
|---|---|
| 1 | insulator |
| 5 | cavity |
| 10 | outer periphery |
| 15 | outer conductor |
| 20 | central bore |
| 25 | inner conductor |
| 30 | front end |
| 35 | back end |
| 40 | coaxial RF device |
| 45 | capacitive break |
| 50 | central area |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. An insulator supporting an inner conductor within the outer conductor of a coaxial device, comprising:

a portion of thermally conductive polymer composition with a thermal conductivity of at least 4 W/m-K; the portion dimensioned with an outer diameter in contact with the outer conductor and a coaxial central bore supporting there through the inner conductor.

2. The insulator of claim 1, further including a plurality of cavities formed in the outer diameter.

3. The insulator of claim 2, wherein the plurality of cavities are each equal in size.

4. The insulator of claim 2, wherein the plurality of cavities is four.

5. The insulator of claim 2, wherein the plurality of cavities each are a generally circle sector shape.

6. The insulator of claim 1, further including a plurality of cavities provided in a front side and a back side of the insulator.

7. The insulator of claim 1, further including at least one cavity provided in one of a front side and a back side of the insulator.

8. The insulator of claim 1, wherein the thermally conductive polymer composition has a dielectric constant, measured at one megahertz, of less than 4.

9. The insulator of claim 1, wherein the thermal conductivity is at least 10 W/m-K.

10. The insulator of claim 1, wherein the insulator is cylindrical.

11. The insulator of claim 1, wherein the portion is a unitary integral portion.

12. A method for manufacturing an insulator for supporting an inner conductor within an outer conductor of a coaxial device, comprising the steps of:

forming a portion of thermally conductive polymer composition with a thermal conductivity of at least 4 W/m-K; the portion dimensioned to have an outer diameter in contact with the outer conductor and a coaxial central bore in contact with the inner conductor.

13. The method of claim 12, wherein the portion is formed via injection molding.

14. The method of claim 12, wherein the portion is cylindrical.

15. The method of claim 12, further including forming a plurality of cavities in the portion.

16. The method of claim 12, wherein the cavities are arranged for two axis mold separation during forming via injection molding.

17. The method of claim 15, wherein the cavities are uniformly distributed around the portion.

18. The method of claim 12, wherein the thermally conductive polymer composition has a thermal conductivity of at least 10 W/m-K.

19. The method of claim 12, wherein the dielectric value of the thermally conductive polymer composition, measured at one megahertz, is less than 4.

20. The method of claim 12, wherein the portion is formed as a unitary integral portion.

* * * * *